US009136589B2

(12) United States Patent
Lee et al.

(10) Patent No.: US 9,136,589 B2
(45) Date of Patent: Sep. 15, 2015

(54) ANTENNA APPARATUS, ELECTRONIC APPARATUS HAVING AN ANTENNA APPARATUS, AND METHOD OF MANUFACTURING THE SAME

(71) Applicants: Hyun-Jae Lee, Yongin (KR); Mu-Gyeom Kim, Yongin (KR)

(72) Inventors: Hyun-Jae Lee, Yongin (KR); Mu-Gyeom Kim, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 215 days.

(21) Appl. No.: 13/962,698

(22) Filed: Aug. 8, 2013

(65) Prior Publication Data

US 2014/0266976 A1 Sep. 18, 2014

(30) Foreign Application Priority Data

Mar. 18, 2013 (KR) ..... 10-2013-0028519

(51) Int. Cl.
*H01Q 1/50* (2006.01)
*H01Q 1/24* (2006.01)
*H01Q 1/12* (2006.01)

(52) U.S. Cl.
CPC ..... *H01Q 1/243* (2013.01); *H01Q 1/1271* (2013.01); *Y10T 29/49018* (2015.01)

(58) Field of Classification Search
USPC ..... 343/872, 873, 906, 702; 439/916; 29/601
See application file for complete search history.

(56) References Cited

U.S. PATENT DOCUMENTS

| | | | | |
|---|---|---|---|---|
| 6,310,586 | B1 * | 10/2001 | Takahashi et al. | 343/872 |
| 2006/0012533 | A1 * | 1/2006 | Noro | 343/713 |
| 2009/0058759 | A1 * | 3/2009 | Morikawa | 343/906 |
| 2014/0132480 | A1 * | 5/2014 | Chou | 343/906 |

FOREIGN PATENT DOCUMENTS

| | | | |
|---|---|---|---|
| KR | 10-2006-0018178 | A | 2/2006 |
| KR | 10-2008-0082165 | A | 9/2008 |
| KR | 10-2011-0092975 | A | 8/2011 |

* cited by examiner

*Primary Examiner* — Tan Ho
(74) *Attorney, Agent, or Firm* — Robert E. Bushnell, Esq.

(57) ABSTRACT

An antenna apparatus, an electronic apparatus having an antenna apparatus, and a method of manufacturing the same. The antenna apparatus includes a window, an antenna pattern, a first contact structure, a substrate and a second contact structure. The antenna pattern is embedded in the window. The first contact structure is electrically connected to the antenna pattern. The substrate is disposed under the window. The second contact structure is disposed on the substrate and is electrically connected to the first contact structure. The second contact structure includes a first contact, a second contact spaced apart from the first contact in a direction substantially perpendicular to the top surface of the substrate and a buffer member having a predetermined elasticity and electrically connecting the first contact with the second contact.

20 Claims, 10 Drawing Sheets

ANTENNA APPARATUS, ELECTRONIC APPARATUS HAVING AN ANTENNA APPARATUS, AND METHOD OF MANUFACTURING THE SAME

CLAIM OF PRIORITY

This application makes reference to, incorporates the same herein, and claims all benefits accruing under 35 U.S.C. §119 from an application earlier filed in the Korean Intellectual Property Office on 18 Mar. 2013 and there duly assigned Serial No. 10-2013-0028519.

BACKGROUND OF THE INVENTION

1. Field of the Invention

Example embodiments relate to antenna apparatuses, electronic apparatuses including antenna apparatuses and methods of manufacturing electronic apparatuses.

2. Description of the Related Art

Electronic apparatuses such as a computer monitor, a laptop, a digital camera, a cellular phone, a smart phone, a smart pad, a television, a personal digital assistant (PDA), a portable multimedia player (PMP), a MP3 player, a navigation system, a game console and a video phone have been widely used. The electronic apparatus also includes an antenna apparatus for a wireless communication.

Recently, the size of the display screen of the electronic apparatus increases, while the volume and the thickness of the electronic apparatus decrease gradually. So it may be hard to receive various components such as an antenna pattern in the limited space of the electronic apparatus.

SUMMARY OF THE INVENTION

Some example embodiments provide an antenna apparatus having an improved radiation performance and a reduced signal loss.

Some example embodiments provide an electronic apparatus including an antenna apparatus having an improved radiation performance and a reduced signal loss.

Some example embodiments provide a method of manufacturing an electronic apparatus including an antenna apparatus having an improved radiation performance and a reduced signal loss.

However, objects of example embodiments are not limited to the above, but can be variously expanded without departing from the present inventive concept.

According to example embodiments, there is provided an antenna apparatus. The antenna apparatus includes a window, an antenna pattern, a first contact structure, a substrate and a second contact structure. The antenna pattern is embedded in the window. The first contact structure is electrically connected to the antenna pattern. The substrate is disposed under the window. The second contact structure on the substrate is electrically connected to the first contact structure. The second contact structure includes a first contact, a second contact spaced apart from the first contact in a direction substantially perpendicular to the top surface of the substrate and a buffer member having a predetermined elasticity and electrically connecting the first contact with the second contact.

In example embodiments, the buffer member may include a conductive material.

In example embodiments, the buffer member may include a spiral coil.

In example embodiments, the antenna apparatus may further comprise a conductive film between the first contact structure and the second contact, and the conductive film may include a conductive fibrous layer.

In example embodiments, the conductive film may directly contact the first contact structure and the second contact In example embodiments, the conductive film may directly contact the second contact. The conductive film may be spaced apart from the first contact structure, and an electrical signal may be transferred between the second contact and the first contact structure by a coupling phenomenon.

In example embodiments, a top surface of the conductive film may have a larger area than a bottom surface of the first contact structure In example embodiments, the first contact structure may be spaced apart from the antenna pattern, and an electrical signal may be transferred between the first contact structure and the antenna pattern by a coupling phenomenon.

In example embodiments, the second contact structure may further comprise a mold pattern between the first contact and the second contact, and the mold pattern may hold the first contact and the second contact.

In example embodiments, the antenna pattern may have a three dimensional structure having an uneven portion, a top surface of the antenna pattern may be lower than a top surface of the window, and a bottom surface of the antenna pattern may be higher than a bottom surface of the window.

According to example embodiments, there is provided an electronic apparatus. The electronic apparatus includes a display panel having a light emission surface, a window disposed on the light emission surface of the display panel and an antenna apparatus partially embedded in the window. The antenna apparatus includes a window, an antenna pattern, a first contact structure, a substrate and a second contact structure. The antenna pattern is embedded in the window. The first contact structure is electrically connected to the antenna pattern. The substrate is disposed under the window. The second contact structure on the substrate is electrically connected to the first contact structure. The second contact structure includes a first contact, a second contact spaced apart from the first contact in a direction substantially perpendicular to the top surface of the substrate and a buffer member having a predetermined elasticity and electrically connecting the first contact with the second contact.

According to example embodiments, there is provided a method of manufacturing an electronic apparatus. In the method, a window is provided to have a recess on a surface of the window. An antenna pattern is formed on an inner wall of the recess. An insulation layer is formed to cover the antenna pattern. The insulation layer fills the recess. A first contact structure is formed through the insulation layer. A display panel and a substrate are disposed in a housing. The housing has an opening. A second contact structure is formed on the substrate. The second contact structure has a first contact, a second contact spaced apart from the first contact in a direction substantially perpendicular to a top surface of the substrate, and a buffer member having a predetermined elasticity and electrically connecting the first contact with the second contact. The window is combined with the housing to cover the opening of the housing, such that the first contact structure is electrically connected to the second contact structure.

According to example embodiments, the antenna apparatus may include an antenna pattern embedded in a window and a second contact structure including a buffer member and a conductive film having a conductive fibrous layer. The antenna pattern may be embedded in the window, so that an additional space for receiving the antenna pattern may be saved, and the shape of the antenna pattern may be easily changed. Therefore, the radiation performance of the antenna apparatus may be improved. Further, the buffer member may absorb an impact between a first contact and a second contact of the second contact structure, so that the window may not be damaged by an external impact. The conductive film may prevent the first pad or the second contact from being damaged by a friction or an abrasion. Accordingly, an electrical signal received by the antenna pattern may be transferred to the first pad on the substrate with a reduced signal loss.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
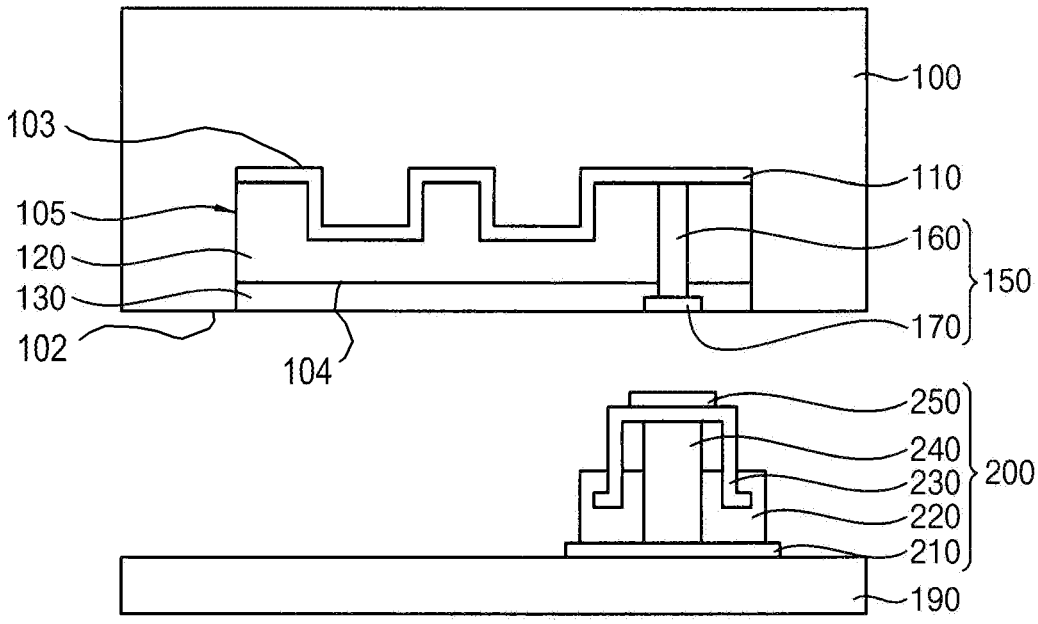
FIGS. 1 and 2 are cross-sectional views illustrating an antenna apparatus in accordance with some embodiments.

Various example embodiments will be described more fully hereinafter with reference to the accompanying drawings, in which some example embodiments are shown. The present inventive concept may, however, be embodied in many different forms and should not be construed as limited to the example embodiments set forth herein. Rather, these example embodiments are provided so that this disclosure will be thorough and complete, and will fully convey the scope of the present inventive concept to those skilled in the art. In the drawings, the sizes and relative sizes of layers and regions may be exaggerated for clarity. Like numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the teachings of the present inventive concept. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular example embodiments only and is not intended to be limiting of the present inventive concept. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
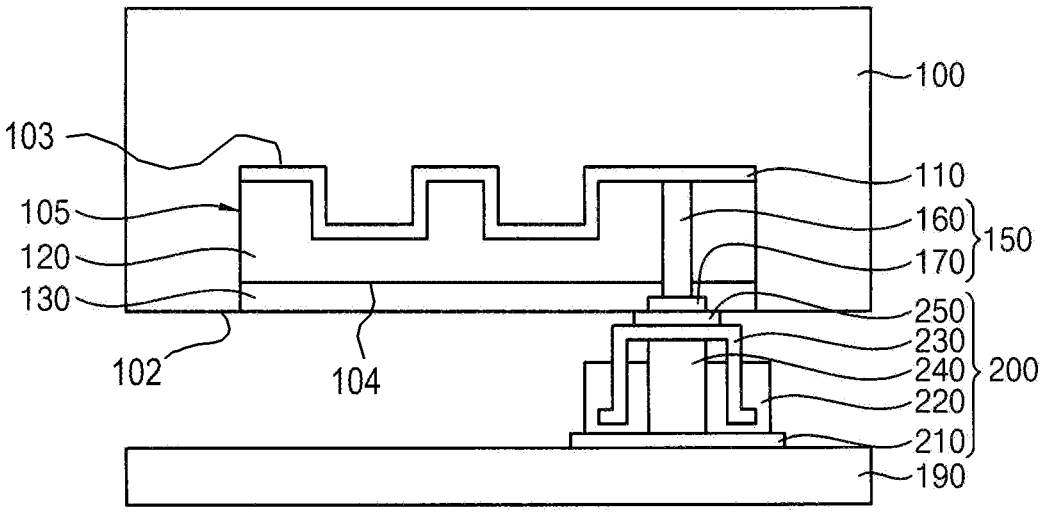

FIGS. 1 and 2 are cross-sectional views illustrating an antenna apparatus in accordance with some embodiments.

FIG. 1 is a cross-sectional view illustrating the antenna apparatus, before combining a window 100 with a substrate 190, and FIG. 2 is a cross-sectional view illustrating the antenna apparatus, after combining the window 100 with the substrate 190.

The window 100 may include some material having a relatively high strength such as glass, quartz or transparent ceramic, or may include other material having a flexibility such as transparent plastic. For example, the window 100 may include transparent plastic, e.g. polycarbonate, polymethyl methacrylate, polystyrene, polyethylene terephthalate, or mixture thereof. In example embodiments, the window 100 may further include a hard coating layer (not shown) to protect a surface thereof and/or an optical function layer (not shown) to perform an optical function. For example, the optical function layer may include a polarization film and/or a retardation film.

In example embodiments, the window 100 having a predetermined transparency may be disposed on a light emission surface of a display panel of an electronic apparatus. That is, the window 100 may be used to protect an organic light emitting diode (OLED) or liquid crystal display (LCD) embedded in the electronic apparatus.

Further, the window 100 may have a recess 105 in a surface 102 of the window 100. In example embodiments, a bottom surface 103 of the recess 105 may have an uneven portion.

An antenna pattern 110 may be embedded in the window 100. That is, the antenna pattern 110 may be disposed on the bottom surface 103 and/or a sidewall of the recess 105. The antenna pattern 110 may be conformably formed on an inner surface of the recess 105, so that the antenna pattern 110 also may have an uneven portion. That is, the antenna pattern 110 may have a square wave pattern conforming to a square wave pattern formed in the bottom surface 103 of the recess 105.

As the antenna pattern 110 may be embedded in the window 100, a top surface of the antenna pattern 110 may be lower than a top surface of the window 100, and a bottom surface of the antenna pattern 110 may be higher than a bottom surface of the window 100. Therefore, the antenna pattern 110 may be covered by the window 100, and the antenna pattern 110 may not be damaged from an external environment. Further, when the antenna pattern 110 has a three dimensional structure having the uneven portion, a surface area of the antenna pattern 110 may increase to improve a radiation performance.

In other example embodiments, the recess 105 may have an even bottom surface, so that a top surface of the antenna pattern 110 may have an even portion.

Further, a planar shape of the antenna pattern 110 may not be limited. That is, the antenna pattern 110 may have various planar shapes such as a plate shape, a loop shape or a branched shape.

The antenna pattern 110 may include a conductive metal or a conductive polymer. The material and the thickness of the antenna pattern 110 may be adjusted depending on a performance of the antenna apparatus and a manufacturing process of the antenna apparatus. The antenna pattern 110 may transmit and/or receive a signal such as a Bluetooth, a wireless fidelity (Wi-Fi), a digital multimedia broadcast (DMB), a global positioning system (GPS) or a communication bandwidth of a mobile terminal.

A planarization layer 120 may be disposed to cover the antenna pattern 110 by filling most of the recess 105. The polarization layer 120 may have a first surface contacting the antenna pattern 110 and a second surface 104 opposing to the first surface, and the second surface 104 may be flat. Therefore, the polarization layer 120 may protect the antenna pattern 110, and may provide a flat surface. The planarization layer 120 may include, for example, an insulation material such as silicon oxide.

An insulation layer 130 may be disposed on the second surface 104 of the planarization layer 120 to fill a remaining portion of the recess 105. Therefore, the insulation layer 130 may form a continuous surface with the surface 102 of the window 100. The insulation layer 130 may include, for example, a material substantially the same as or substantially similar to that of the planarization layer 120. Further, the insulation layer 130 and the planarization layer 120 may include an insulation material, so that the insulation layer 130 and the planarization layer 120 may not affect the radiation performance of the antenna apparatus.

In other example embodiments, an additional sub-antenna pattern (not shown) may be disposed between the planarization layer 120 and the insulation layer 130. The additional sub-antenna pattern may improve the radiation performance of the antenna apparatus, or may transmit and/or receive a signal having a bandwidth different from that of the antenna pattern 110. In other example embodiments, the planarization layer 120 and the insulation layer 130 may be integrally formed, or either the planarization layer 120 or the insulation layer 130 may be omitted.

Referring now to FIG. 1, a first contact structure 150 may be disposed through the planarization layer 120 and the insulation layer 130. In example embodiments, the first contact structure 150 may include a plug 160 and a first pad 170.

The plug 160 may be disposed through the planarization layer 120 and the insulation layer 130 in the recess 105 of the window 100. The plug 160 may include a conductive material, and may directly contact the antenna pattern 110. That is, the plug 160 may be electrically connected to the antenna pattern 110.

The first pad 170 may be disposed in the insulation layer 130. The first pad 170 may have a first surface directly contacting the plug 160 and a second surface opposing to the first surface. The second surface of the first pad 170 may form a continuous surface with the surface 102 of the window 100. Therefore, the first pad 170 may be electrically connected to the antenna pattern 110 by the plug 160, and the second surface of the first pad 170 may be exposed by the insulation layer 130. For example, the first pad 170 may have a planar shape such as a circular or rectangular shape.

Consequently, the first contact structure 150 may be electrically connected to the antenna pattern 110. It will be understood that when an element is referred to as being "electrically connected" to another element, it can be connected to the other element by a direct contact, or it can be spaced apart from the other element by a insulation material and can transmit and/or receive a signal by a coupling phenomenon. In example embodiments, the first contact structure 150 may directly contact the antenna pattern 110 as illustrated in FIG. 1.

The substrate 190 may be disposed under the window 100. The substrate 190 may serve, for example, as a main board of the antenna apparatus. The substrate 190 may include a ground plane, a chip, a circuit pattern, and a radio frequency (RF) connector for a wireless communication.

A second contact structure 200 may be disposed between the substrate 190 and the window 100. In example embodiments, the second contact structure 200 may include a first contact 210, a mold pattern 220, a second contact 230, a buffer member 240 and a conductive film 250.

The first contact 210 including a conductive material may be disposed on the substrate 190. The first contact 210 may be electrically connected to other devices by a wiring (or a conductive pattern) on the substrate 190. In other example embodiments, a pad (not shown) may be further disposed between the first contact 210 and the substrate 190. In example embodiments, the first contact 210 may be mounted on a top surface of the substrate 190 by a soldering process. The first contact 210 may be electrically connected, for example, to an RF connector or a ground plane on the substrate 190 by a feed terminal or a ground terminal, respectively.

The second contact 230 may be disposed above the first contact 210. The second contact 230 may be spaced apart from the first contact 210 in a direction substantially perpendicular to the top surface of the substrate 190. That is, the second contact 230 may not directly contact the first contact 210. In example embodiments, the second contact 230 may include a conductive material substantially the same as or substantially similar to that of the first contact 210. The first contact 210 and the second contact 230 may include a conductive material, a signal loss may be reduced in the first contact 210 and the second contact 230.

The mold pattern 220 may be disposed between the first contact 210 and the second contact 230. The mold pattern 220 may include an insulation material. The first contact 210 and the second contact 230 may be separated by the mold pattern 220. Further, the mold pattern 220 may hold the first contact 210 and the second contact 230, and may protect portions of the first contact 210 and the second contact 230 adjacent to the mold pattern 220. That is, the portions of the first contact 210 and the second contact 230, which may be covered by the mold pattern 220, may not be damaged by an external impact.

Further, a buffer member 240 may be disposed through the mold pattern 220 between the first contact 210 and the second contact 230. In example embodiments, the buffer member 240 may include a conductive material, and may directly contact the first contact 210 and the second contact 230. Therefore, the first contact 210 and the second contact 230 may be electrically connected. The buffer member 240 may have a predetermined elasticity. When an external impact is applied in the direction substantially perpendicular to the top surface of the substrate 190, the buffer member 240 between the first contact 210 and the second contact 230 may absorb the shock created by the external impact.

The conductive film 250 may be disposed on the second contact 230. In example embodiments, the conductive film 250 may include a conductive fibrous layer. Therefore, the conductive fibrous layer may prevent the first pad 170 or the second contact 230 from being damaged by a friction or an abrasion due to a direct contact between the first pad 170 and the second contact 230. The material and the thickness of the conductive fibrous layer may be adjusted depending on the bandwidth of the electrical signal and attenuation of the electrical signal. A top surface of the conductive film 250 has a larger area than a bottom surface of the first contact structure 150.

In other example embodiments, the conductive film 250 may further include a conductive adhesion layer on a top surface and/or a bottom surface of the conductive fibrous layer. Due to the conductive adhesion layer, the first contact structure 150 and the second contact structure 200 may be connected stably.

Referring to FIG. 2, when the window 100 including the antenna pattern 110 is coupled to the second contact structure 200 on the substrate 190, the buffer member 240 is partially compressed in the mold pattern 220. Therefore, the window 100 may not be damaged or cracked during the process for combining the window 100 with the substrate 190.

According to example embodiments, the antenna apparatus may include the antenna pattern 110 embedded in the window 100, the first contact structure 150, the second contact structure 200 including the buffer member 240, and the conductive film 250 having the conductive fibrous layer. The antenna pattern 110 may be embedded in the window 100, so that an additional space for receiving the antenna pattern 110 may be saved, and the shape of the antenna pattern 110 may be easily changed. Therefore, the radiation performance of the antenna apparatus may be improved. Further, the buffer member 240 may be further compressed between the first contact 210 and the second contact 230 to absorb a shock created by an external impact, thus the window 100 may not be damaged by an external impact. The conductive film 250 including the conductive fibrous layer may prevent the first pad 170 from being damaged by a friction or an abrasion. Accordingly, an electrical signal received by the antenna pattern 110 may be transferred to the first contact 210 on the substrate 190 with a reduced signal loss.

Figure 3:
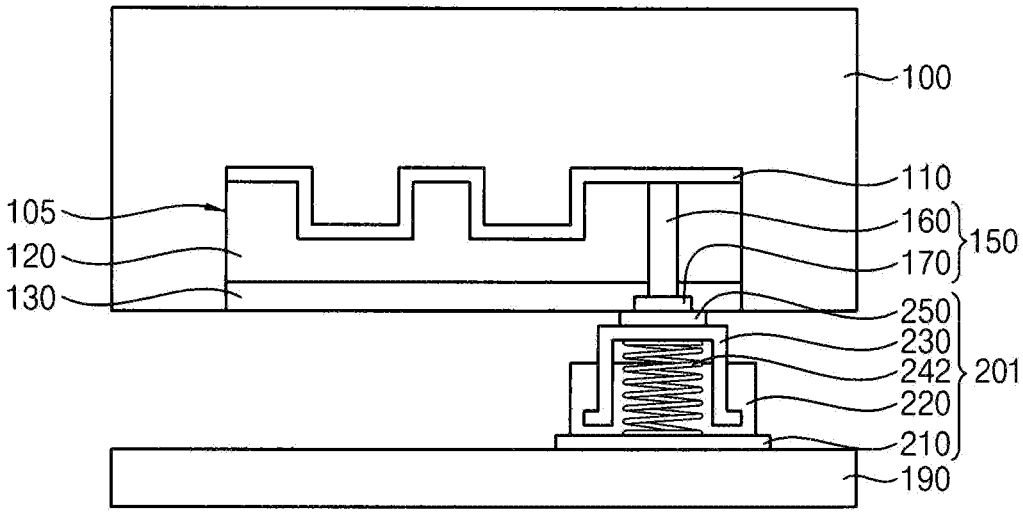
FIG. 3 is a cross-sectional view illustrating an antenna apparatus in accordance with some embodiments.

FIG. 3 is a cross-sectional view illustrating an antenna apparatus in accordance with other embodiments.

Referring to FIG. 3, the antenna apparatus may include an antenna pattern 110 embedded in the window 100, a first contact structure 150 and a second contact structure 201 on a substrate 190. The antenna apparatus may be substantially the same as or substantially similar to the antenna apparatus described with reference to FIGS. 1 and 2 except for a spiral coil 242. Accordingly, the same reference numerals may be designated to the same constituting elements, and detailed explanation on these elements may be omitted.

The spiral coil 242 may be disposed through the mold pattern 220 between the first contact 210 and the second contact 230. The spiral coil 242 may directly contact the first contact 210 and the second contact 230, so that the first contact 210 and the second contact 230 may be electrically connected by the spiral coil 242. In example embodiments, the spiral coil 242 may include a metal and may have a predetermined elasticity. When an external impact is applied in the direction substantially perpendicular to a top surface of a substrate 190, the spiral coil 242 between the first contact 210 and the second contact 230 may absorb a shock created by the external impact. The antenna apparatus may include a single spiral coil 242 as illustrated in FIG. 3. However the present inventive concept is not limited to FIG. 3, and the antenna apparatus may include multiple spiral coils.

Figure 4:
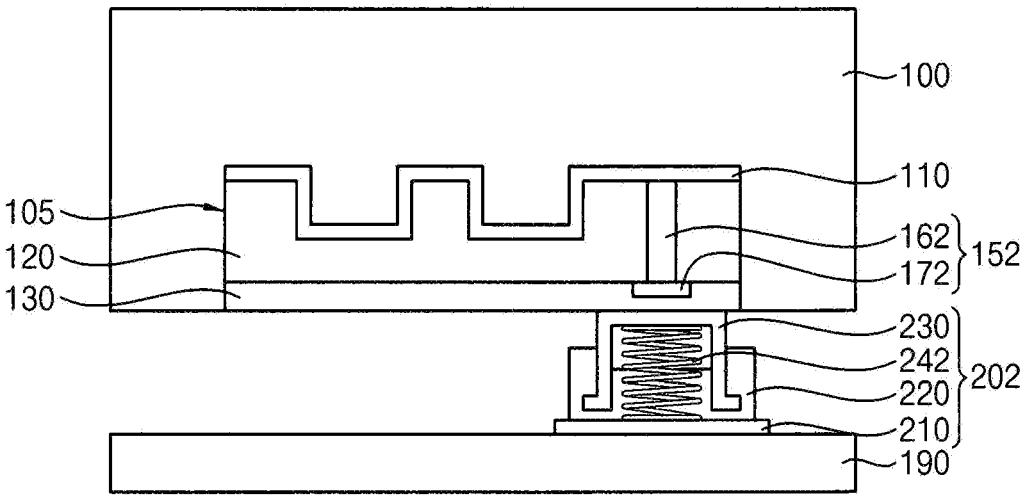
FIG. 4 is a cross-sectional view illustrating an antenna apparatus in accordance with some embodiments.

FIG. 4 is a cross-sectional view illustrating an antenna apparatus in accordance with other embodiments.

Referring to FIG. 4, the antenna apparatus may include an antenna pattern 110 embedded in a window 100, a first contact structure 152 and a second contact structure 202 on a substrate 190. The antenna apparatus may be substantially the same as or substantially similar to the antenna apparatus described with reference to FIG. 3 except for a first pad 172 and a plug 162. Accordingly, the same reference numerals may be designated to the same constituting elements, and detailed explanation on these elements may be omitted.

The window 100 may be used to protect an organic light emitting diode (OLED) or liquid crystal display (LCD) embedded in the electronic apparatus. The antenna pattern 110 may be disposed on a bottom surface and/or a sidewall of a recess 105 of the window 100. Further, a planarization layer 120 and an insulation layer 130 may be disposed to fill the recess 105.

The first contact structure 152 may be disposed through the planarization layer 120 and the insulation layer 130. In example embodiments, the first contact structure 152 may include the plug 162 and the first pad 172. The plug 162 and the first pad 172 may be substantially the same as or substantially similar to the plug 160 and the first pad 170 described in FIG. 1, however, in example embodiments (not shown), the plug 162 may not directly contact the first pad 172.

The substrate 190 may be disposed under the window 100, and the second contact structure 202 may be disposed on the substrate 190. The second contact structure 202 may include the first contact 210, the mold pattern 220, the second contact 230, and a buffer member such as the spiral coil 242.

In example embodiments, the second contact 230 and the first pad 172 may be separated by insulation layer 130. The conductive film 250 of FIG. 3 is not present in this embodiment. The insulation layer 130 may have a relatively small thickness, and may include a material having a relatively high dielectric constant, so that an electrical signal may be transferred between the second contact 230 and the first pad 172 by a coupling phenomenon.

According to example embodiments, the antenna apparatus may include the first pad 172 and the second contact 230 which may be indirectly connected by the coupling phenomenon. The first pad 172 and the second contact 230 may not directly contact each other, so that an electrostatic problem may be reduced. Further, the first pad 172 may be protected by the insulation layer 130, so that the first pad 172 may not be damaged by a friction or an abrasion.

Figure 5:
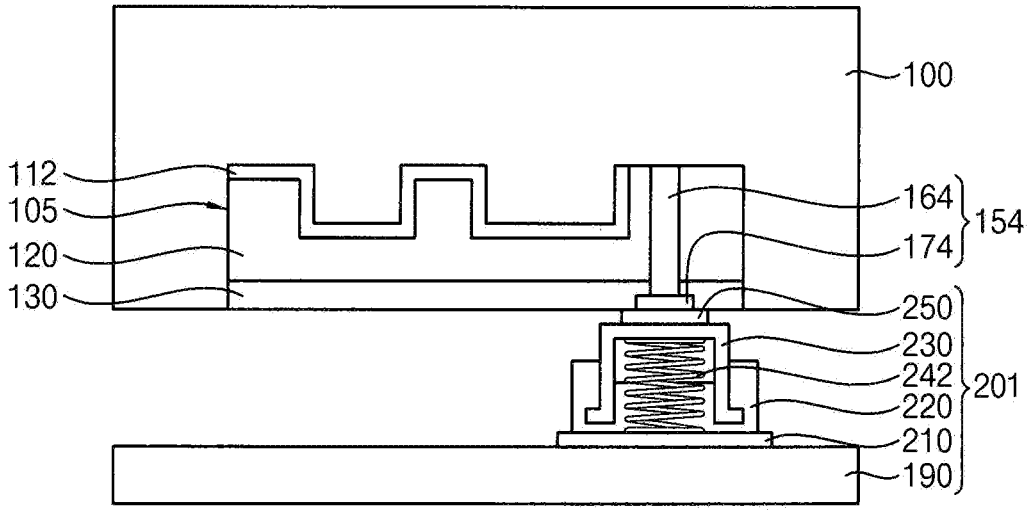
FIG. 5 is a cross-sectional view illustrating an antenna apparatus in accordance with some embodiments.

FIG. 5 is a cross-sectional view illustrating an antenna apparatus in accordance with other embodiments.

Referring to FIG. 5, the antenna apparatus may include an antenna pattern 112 embedded in a window 100, a first contact structure 154 and a second contact structure 201 on a substrate 190. The antenna apparatus may be substantially the same as or substantially similar to the antenna apparatus described with reference to FIG. 3 except for a first pad 174 and a plug 164. Accordingly, the same reference numerals may be designated to the same constituting elements, and detailed explanation on these elements may be omitted.

The window 100 may be used to protect an organic light emitting diode (OLED) or liquid crystal display (LCD) embedded in the electronic apparatus. The antenna pattern 112 may be disposed on a bottom surface and/or a sidewall of a recess 105 of the window 100. Further, a planarization layer 120 and an insulation layer 130 may be disposed to fill the recess 105.

The first contact structure 154 may be disposed through the planarization layer 120 and the insulation layer 130. In example embodiments, the first contact structure 154 may include the plug 164 and the first pad 174. The plug 164 and the first pad 174 may be substantially the same as or substantially similar to the plug 160 and the first pad 170 described in FIGS. 1-3, however, the plug 164 may not directly contact the antenna pattern 112, as shown.

The substrate 190 may be disposed under the window 100, and the second contact structure 201 may be disposed on the substrate 190. The second contact structure 201 may include a first contact 210, a mold pattern 220, a second contact 230, a buffer member such as a spiral coil 242, and a conductive film 250.

In example embodiments, the antenna pattern 112 and the plug 164 may be separated by the planarization layer 120. The planarization layer 120 may have a relatively small thickness between the antenna pattern 112 and the plug 164, and may include a material having a relatively high dielectric constant, so that an electrical signal may be transferred between the antenna pattern 112 and the plug 164 by a coupling phenomenon.

According to example embodiments, the antenna apparatus may include the antenna pattern 112 and the plug 164 which may be indirectly connected by the coupling phenomenon. The antenna pattern 112 and the plug 164 may not directly contact each other, so that an electrostatic problem may be reduced. Further, the antenna pattern 112 may be protected by the polarization layer 120, so that the antenna pattern 112 may not be damaged during the process for forming the plug 164 such as an etching process.

Figure 6:
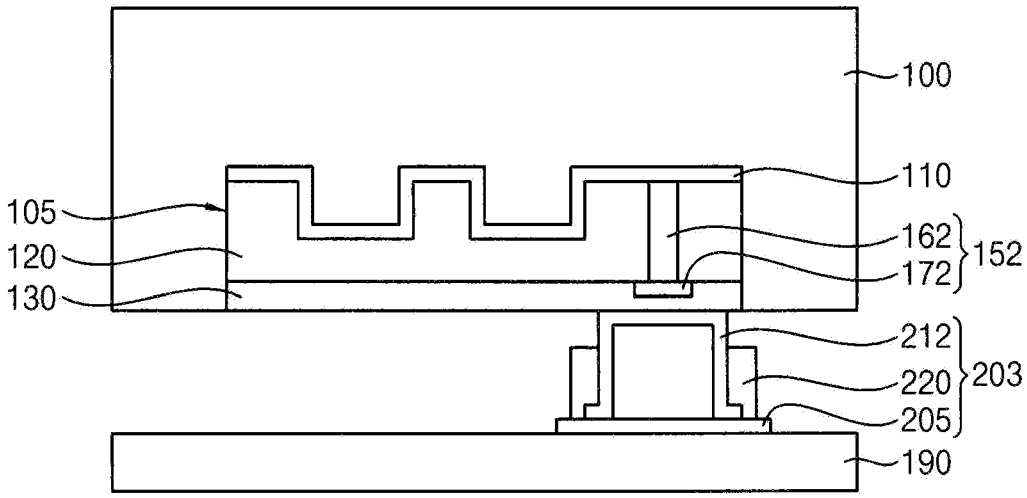
FIG. 6 is a cross-sectional view illustrating an antenna apparatus in accordance with some embodiments.

FIG. 6 is a cross-sectional view illustrating an antenna apparatus in accordance with other embodiments.

Referring to FIG. 6, the antenna apparatus may include an antenna pattern 110 embedded in a window 100, a first contact structure 152 and a second contact structure 203 on a substrate 190. The antenna apparatus may be substantially the same as or substantially similar to the antenna apparatus described with reference to FIG. 4 except for the second contact structure 203. Accordingly, the same reference numerals may be designated to the same constituting elements, and detailed explanation on these elements may be omitted.

The window 100 may be used to protect an organic light emitting diode (OLED) or liquid crystal display (LCD) embedded in the electronic apparatus. The antenna pattern 110 may be disposed on a bottom surface and/or a sidewall of a recess 105 of the window 100. Further, a planarization layer 120 and an insulation layer 130 may be disposed to fill the recess 105.

The first contact structure 152 may be disposed through the planarization layer 120 and the insulation layer 130. In example embodiments, the first contact structure 152 may include the plug 162 and the first pad 172. The second contact structure 203 may include a first contact 212, a mold pattern 220 and a second pad 205. Further, the first contact 212 may directly contact the second pad 205.

In example embodiments, the first contact 212 and the first pad 172 may be separated by insulation layer 130. The insulation layer 130 may have a relatively small thickness, and may include a material having a relatively high dielectric constant, so that an electrical signal may be transferred between the first contact 212 and the first pad 172 by a coupling phenomenon.

According to example embodiments, the antenna apparatus may include the first pad 172 and the first contact 212 which may be indirectly connected by the coupling phenomenon. The first pad 172 and the first contact 212 may not directly contact each other, so that an electrostatic problem may be reduced. Further, the first pad 172 may be protected by the insulation layer 130, so that the first pad 172 may not be damaged by a friction or an abrasion.

Figure 7:
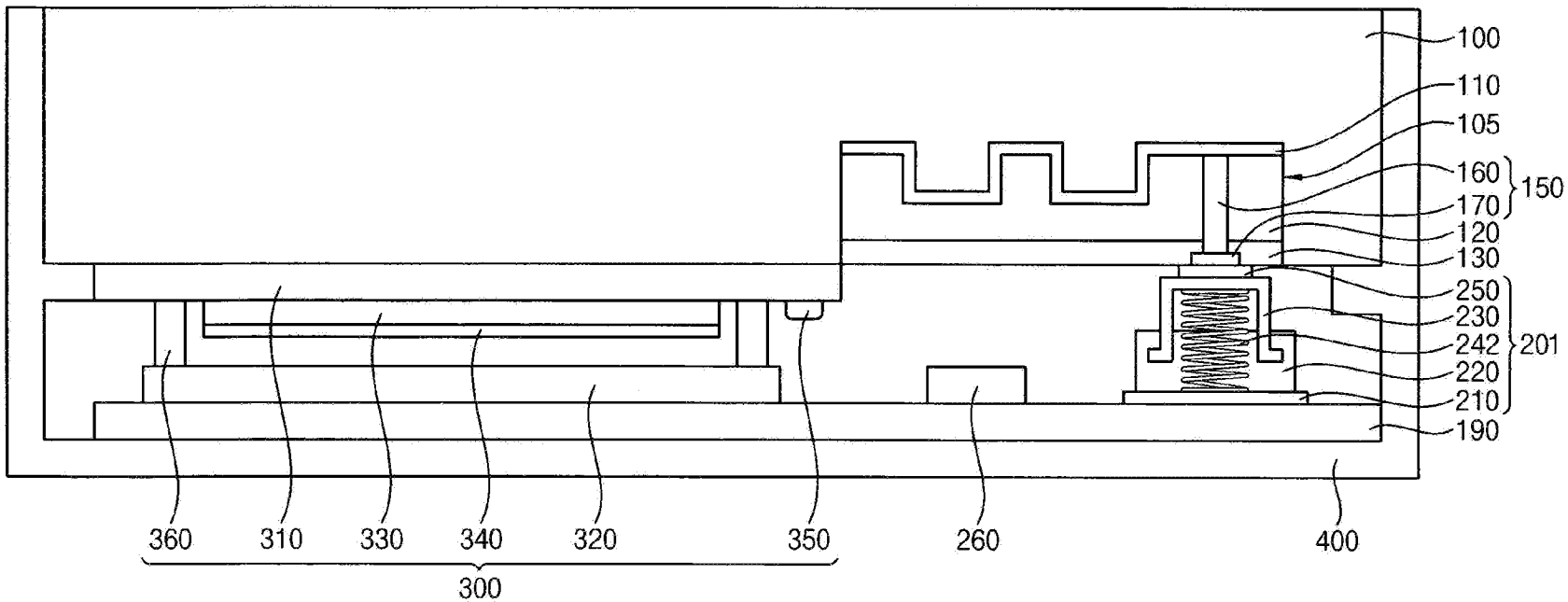
FIG. 7 is a cross-sectional view illustrating an electronic apparatus in accordance with some embodiments.

FIG. 7 is a cross-sectional view illustrating an electronic apparatus in accordance with some embodiments.

Referring to FIG. 7, the electronic apparatus may include a window 100, a substrate 190, a second contact structure 201, a display panel 300 and housing 400. Further, an antenna pattern 110 and a first contact structure 150 may be embedded in the window 100. The window 100, the antenna pattern 110, the first contact structure 150 and the second contact structure 201 may be substantially the same as or substantially similar to the window 100, the antenna pattern 110, the first contact structure 150 and the second contact structure 201 described in FIG. 3.

In example embodiments, the electronic apparatus may include not only a stationary electronic apparatus such as a monitor, a television and a digital information display (DID) but also a mobile electronic apparatus such as a notebook, a digital camera, a cellular phone, a smart phone, a smart pad, a personal digital assistant (PDA), a portable multimedia player (PMP), a mp3 player, a navigation system, a camcorder and a portable game console.

The housing 400 may have an opening in an upward direction. A bottom surface and a sidewall of the housing 400 may protect components of the electronic apparatus disposed in the housing 400.

The substrate 190 may be disposed in the housing 400. For example, the substrate 190 may include a printed circuit board, and may serve as a main board of the electronic apparatus. A circuit portion 260 may be disposed on the substrate 190. The circuit portion 260 may include, though not shown and not limited to, a ground plane, a chip, a circuit pattern, and an RF connector.

The display panel 300 may include a flat display panel which may display information of images or characters based on an electrical signal. For example, the display panel 300 may include an organic light emitting diode (OLED) panel including a first display substrate 310, a second display substrate 320, a switching structure 330, an organic light emitting structure 340, a peripheral circuit portion 350, a sealant 360 disposed between the first display substrate 310 and the second display substrate 320.

In example embodiments (not shown), the switching structure 330, the organic light emitting structure 340 and the peripheral circuit portion 350 may be disposed between the first display substrate 310 and the second display substrate 320.

The first display substrate 310 may include a transparent material. For example, the first display substrate 310 may include, though not shown and not limited to, alkali-free glass, quartz, transparent plastic. Alternatively, the first display substrate 310 may include a flexible substrate.

The first display substrate 310 may be divided into a display region and a peripheral region. The organic light emitting structure 340 may be disposed in the display region of the first display substrate 310, and the peripheral circuit portion 350 may be disposed in the peripheral region of the first display substrate 310.

When the display panel 300 has an active matrix type, the display panel 300 may include the switching structure 330 disposed on the first display substrate 310. For example, the switching structure 330 may include, though not shown and not limited to, a switching device, at least one insulation layer, a contact, a pad and a plug.

The organic light emitting structure 340 may be disposed on the switching structure 330. The organic light emitting structure 340 may include a plurality of organic layers. For example, the organic light emitting structure 340 may include, though not shown and not limited to, a hole injection layer (HIL), a hole transport layer (HTL), an organic light emitting layer, an electron injection layer (EIL) and an electron transport layer (ETL). In example embodiments, the organic light emitting layer may include an organic material or a mixture of an organic material and an inorganic material for generating a red color of light, a green color of light and/or a blue color of light. Alternatively, the organic light emitting layer may have a stacked structure that includes a plurality of light emitting films for generating the red color of light, the green color of light and the blue color of light to thereby provide a white color of light.

The peripheral circuit portion 350 may include, though not shown and not limited to, a peripheral circuit such as a gate driver, a data driver, a common power line and a drive power line and not limited to. The peripheral circuit portion 350 may receive a signal from the circuit portion 260, and may drive the organic light emitting structure 340.

Referring now to FIG. 7, the second display substrate 320 may be substantially opposed to the first display substrate 310. The second display substrate 320 may include a transparent material or an opaque material. For example, the second display substrate 320 may include a transparent material such as glass, quartz and transparent plastic or an opaque material such as a metal and a metal oxide.

The sealant 360 may be disposed between the first display substrate 310 and the second display substrate 320. The sealant 360 may encapsulate a space between the first display substrate 310 and the second display substrate 320, so that the organic layers of the organic light emitting structure 340 may not be degraded.

The window 100 may be disposed to cover the opening of the housing 400. Therefore, the window 100 may protect the display panel 300 in the housing 400. Further, an antenna pattern 110 embedded in the window 100 may be electrically connected to the substrate 190 or the circuit portion 260 by the first contact structure 150 and the second contact structure 201.

In example embodiments, the antenna pattern 110 may be disposed to not overlap the display panel 300. Therefore, the antenna pattern 110 may not disturb the visibility of the display panel 300.

In example embodiments, the antenna pattern 110 may be used as a main antenna pattern of the electronic apparatus. Alternatively, the antenna pattern 110 may be used as a sub-antenna pattern of the electronic apparatus which may improve the radiation performance of the antenna apparatus, or transmit and/or receive a signal having a bandwidth different from that of a main antenna pattern.

In example embodiments, the electronic apparatus may further include, though not shown, a speaker, a microphone, a key button or a touch panel.

According to example embodiments, the electronic apparatus may include the display panel 300 and the second contact structure 201 disposed in the housing 400, and may further include the antenna pattern 110 and the first contact structure 150 embedded in the window 100. The antenna pattern 110 may be embedded in the window 100, so that an additional space for receiving the antenna pattern 110 may be saved, and the shape of the antenna pattern 110 may be easily changed. Further, a buffer member such as a spiral coil 242 may absorb an impact between the first contact 210 and the second contact 230, so that the window 100 may not be damaged by an external impact when combining the window 100 with the housing 400. The conductive film 250 including the conductive fibrous layer may prevent the first pad 170 from being damaged by a friction or an abrasion.

The buffer member may include the spiral coil 242 as illustrated in FIG. 7, however the present inventive concept is not limited thereto, and the buffer member may include any element which has a predetermined elasticity and conductivity.

Figure 8:
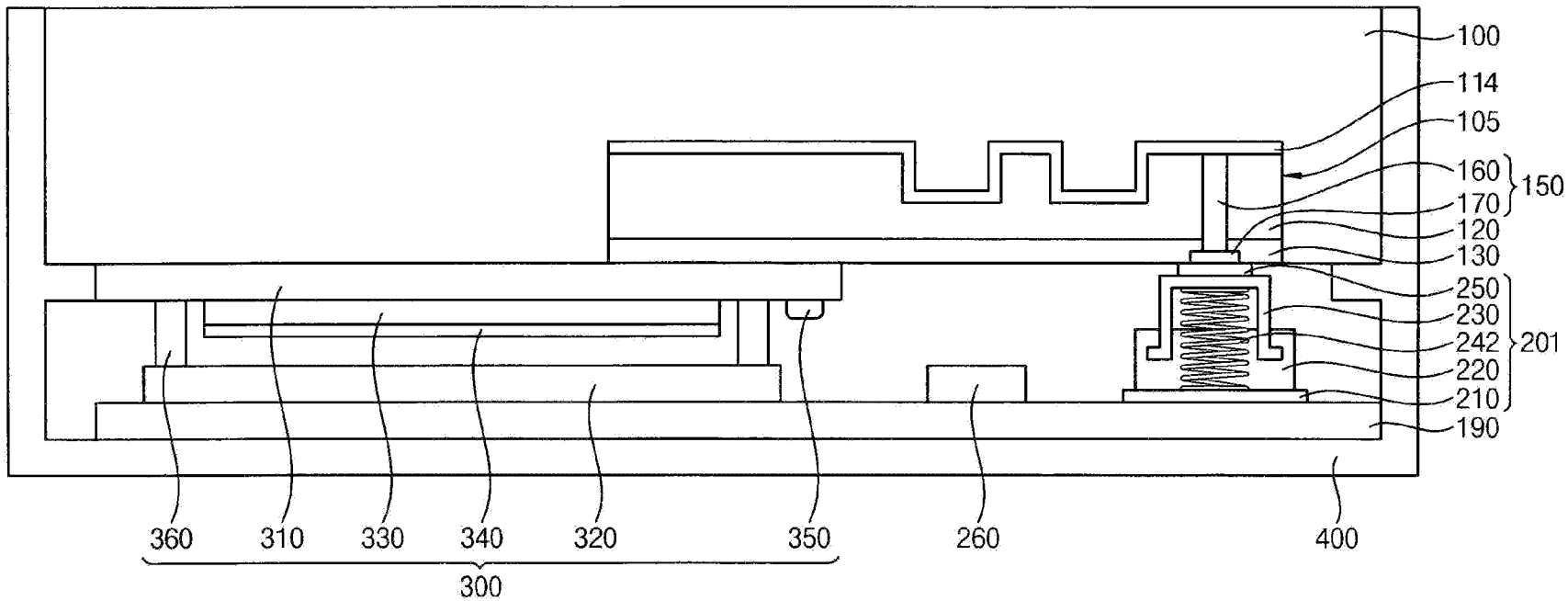
FIG. 8 is a cross-sectional view illustrating an electronic apparatus in accordance with other embodiments.

FIG. 8 is a cross-sectional view illustrating an electronic apparatus in accordance with other embodiments.

Referring to FIG. 8, the electronic apparatus may include a window 100, a substrate 190, a second contact structure 201, a display panel 300 and a housing 400, and an antenna pattern 114 and a first contact structure 150 may be embedded in the window 100. The electronic apparatus may be substantially the same as or substantially similar to the electronic apparatus described with reference to FIG. 7 except for the antenna pattern 114. Accordingly, the same reference numerals may be designated to the same constituting elements, and detailed explanation on these elements may be omitted.

The antenna pattern 114 may be disposed on a bottom surface and/or a sidewall of a recess 105 of the window 100. For example, the antenna pattern 114 may include a transparent conductive material.

In example embodiments, the antenna pattern 114 may partially (or entirely) overlap the display panel 300. Therefore, the antenna pattern 114 may have a relatively large surface area, and the radiation performance of the electronic apparatus may increase. Further, the antenna pattern 114 may include a transparent material, and the antenna pattern 114 may not disturb the visibility of the display panel 300.

FIGS. 9 to 13 are cross-sectional views illustrating a method of manufacturing an electronic apparatus in accordance with some embodiments.

Figure 9:
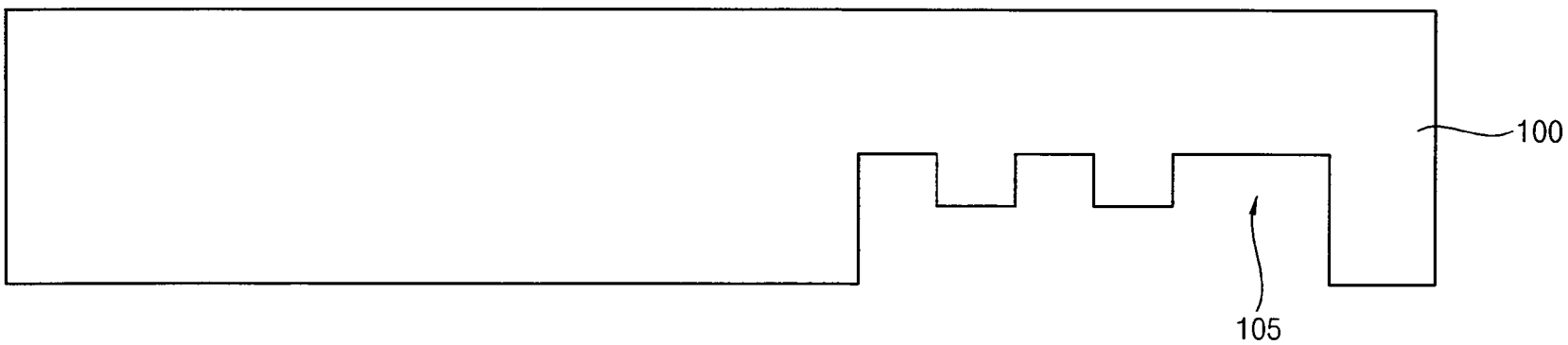
FIGS. 9 to 13 are cross-sectional views illustrating a method of manufacturing an electronic apparatus in accordance with some embodiments.

Referring to FIG. 9, a recess 105 may be formed on a surface of a window 100.

In example embodiments, a portion of the window 100 may be removed by an engraving process to form the recess 105. Alternatively, the window 100 having the recess 105 may be formed by an extrusion process or an injection molding process.

The shape and the size of the recess 105 may be adjusted depending on the shape and the size of the antenna pattern 110. The shape and the size of the recess 105 may be determined as a three dimensional computer-aided design (CAD) data according to a signal frequency, a transmitted/received power and an impedance of the signal. Then, the recess 105 may be formed depending on the CAD data.

Figure 10:
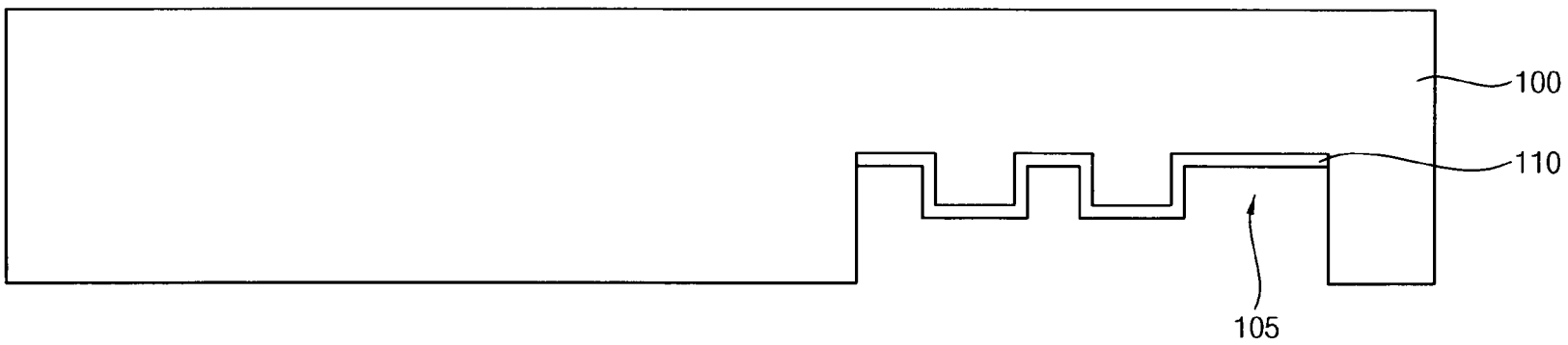

Referring to FIG. 10, an antenna pattern 110 may be formed on a bottom surface and/or a sidewall of the recess 105.

In example embodiments, the antenna pattern 110 may be formed by depositing a conductive material on the window 100. Alternatively, the antenna pattern 110 may be formed by coating a conductive ink or a conductive polymer. Therefore, the antenna pattern 110 may be conformably formed partially on inner surfaces of the recess 105.

Figure 11:
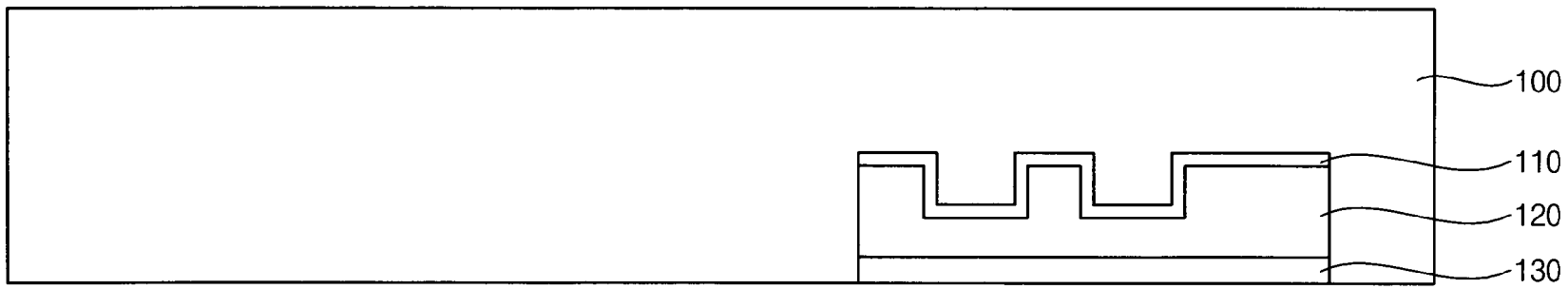

Referring to FIG. 11, a planarization layer 120 and an insulation layer 130 may be formed to fill the recess 105.

The planarization layer 120 and the insulation layer 130 may be formed using an insulation material by a deposition process or a coating process. The planarization layer 120 and the insulation layer 130 may protect the antenna pattern 110.

Alternatively, either the planarization layer 120 or the insulation layer 130 may be omitted.

Figure 12:
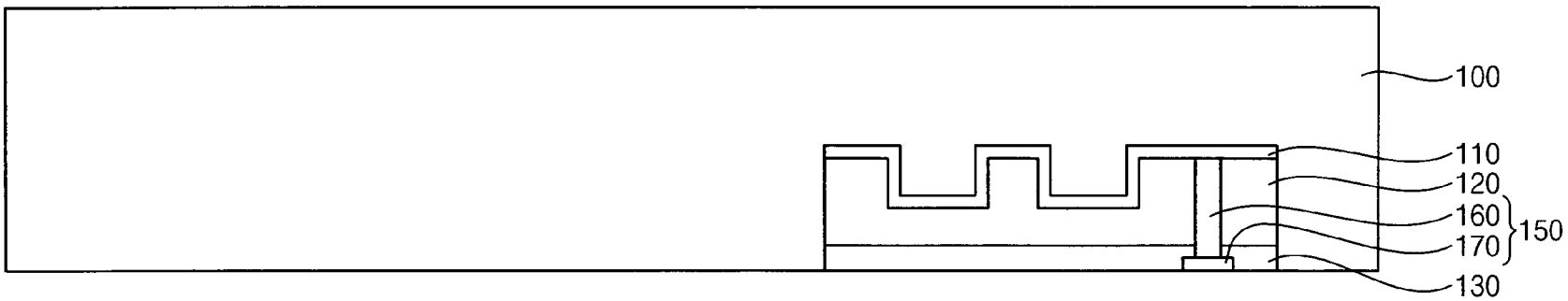

Referring to FIG. 12, a plug 160 and a first pad 170 may be formed through the planarization layer 120 and the insulation layer 130.

A hole may be formed through the planarization layer 120 and the insulation layer 130 to expose the antenna pattern 110, a conductive layer may be formed to fill the hole, and an upper portion of the conductive layer may be removed to form a plug 160. The plug 160 may be electrically connected to the antenna pattern 110. Then, the first pad 170 may be formed to be electrically connected to the plug 160.

Figure 13:
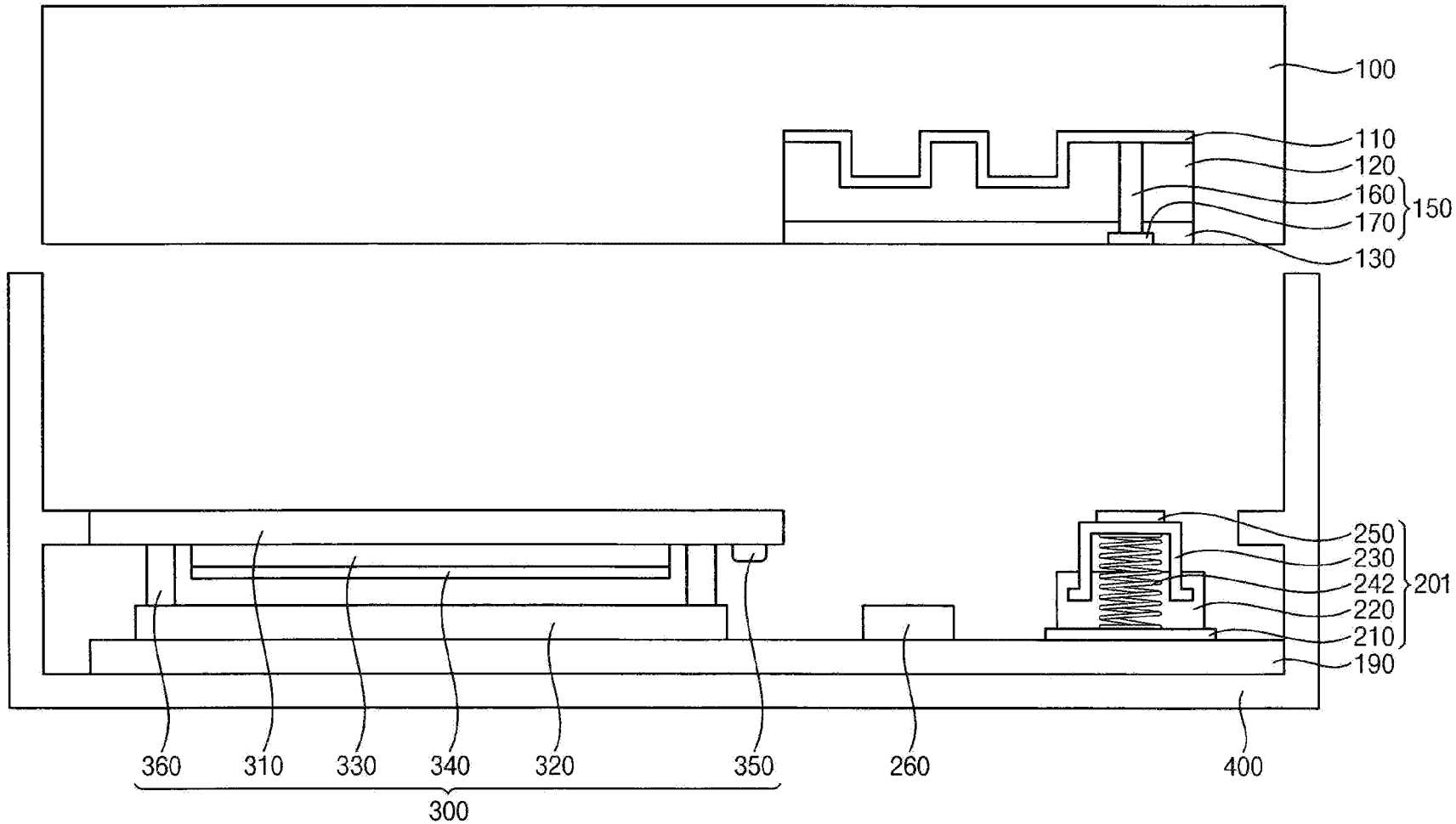

Referring to FIG. 13, the window 100 may be combined with a housing 400.

A substrate 190, a display panel 300 and a second contact structure 201 may be disposed in the housing 400.

Then, the window 100 may be combined with a housing 400 to cover an opening of the housing 400. The first contact structure 150 may be electrically connected to the second contact structure 201. The second contact structure 201 may include a buffer member such as a spiral coil 242, so that the buffer member may absorb an impact when combining the window 100 with the housing 400, thus the window 100 may not be damaged by an external impact.

The buffer member may include the spiral coil 242 as illustrated in FIG. 7, however the present inventive concept is not limited thereto, and the buffer member may include any element which has a predetermined elasticity and conductivity.

The present inventive concept may be applied to a system having an antenna pattern and a window. For example, the present inventive concept may be applied to, but is not limited thereto, a computer monitor, a laptop, a digital camera, a cellular phone, a smart phone, a smart pad, a television, a personal digital assistant (PDA), a portable multimedia player (PMP), a MP3 player, a navigation system, a game console or a video phone.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. An antenna apparatus, comprising:

an antenna pattern embedded in a window;

a first contact structure electrically connected to the antenna pattern;

a substrate under the window, the substrate including a circuit portion thereon; and a second contact structure on the substrate, the second contact structure being electrically connected to the first contact structure, the second contact structure comprising:

a first contact disposed directly on the substrate;

a second contact spaced apart from the first contact in a direction substantially perpendicular to a top surface of the substrate; and a buffer member having a predetermined elasticity, the buffer member electrically connecting the first contact with the second contact.

2. The antenna apparatus of claim 1, the buffer member including a conductive material.

3. The antenna apparatus of claim 1, the buffer member including a spiral coil.

4. The antenna apparatus of claim 1, further comprising a conductive film disposed between the first contact structure and the second contact, the conductive film including a conductive fibrous layer.

5. The antenna apparatus of claim 4, the conductive film directly contacting the first contact structure and the second contact.

6. The antenna apparatus of claim 4, the conductive film directly contacting the second contact, the conductive film being spaced apart from the first contact structure, an electrical signal being transferred between the second contact and the first contact structure by a dielectric coupling phenomenon.

7. The antenna apparatus of claim 4, a top surface of the conductive film having a larger area than a bottom surface of the first contact structure.

8. The antenna apparatus of claim 1, the first contact structure being spaced apart from the antenna pattern, an electrical signal being transferred between the first contact structure and the antenna pattern by a dielectric coupling phenomenon.

9. The antenna apparatus of claim 1, the second contact structure further comprising a mold pattern between the first contact and the second contact, and the mold pattern holding the second contact apart from the first contact.

10. The antenna apparatus of claim 1, the antenna pattern having a three dimensional structure having an uneven portion, a top surface of the antenna pattern being lower than a top surface of the window, and a bottom surface of the antenna pattern being higher than a bottom surface of the window.

11. The antenna apparatus of claim 1, the window having a recess, a bottom surface of the recess having an uneven portion, the antenna pattern being conformably formed on the bottom surface of the recess.

12. The antenna apparatus of claim 11, further comprising a planarization layer disposed within the recess to embed the antenna pattern in the window.

13. The antenna apparatus of claim 12, further comprising an insulation layer disposed in the window in a bottom surface of the planarization layer, a bottom surface of the insulation layer being even with a bottom surface of the window.

14. The antenna apparatus of claim 1, the first contact structure comprising:

a plug; and a pad formed adjacent to the plug, the first contact structure being embedded in the window, the pad being electrically connected to the plug and the second contact.

15. An electronic apparatus, comprising:

a display panel having a light emission surface;

a window disposed on the light emission surface of the display panel; and an antenna apparatus partially embedded in the window, wherein the antenna apparatus comprises:

an antenna pattern embedded in the window;

a first contact structure electrically connected to the antenna pattern, the first contact structure being embedded in the window;

a substrate disposed under the window, the substrate supporting the display panel and including a circuit portion thereon; and a second contact structure disposed on the substrate, the second contact structure being electrically connected to the first contact structure, the second contact structure comprising:

a first contact formed on the substrate;

a second contact spaced apart from the first contact in a direction substantially perpendicular to a top surface of the substrate; and a buffer member having a predetermined elasticity, the buffer member electrically connecting the first contact to the second contact.

16. The electronic apparatus of claim 15, further comprising a conductive film disposed between the first contact structure and the second contact, the conductive film including a conductive fibrous layer.

17. The electronic apparatus of claim 16, the conductive film directly contacting the first contact structure and the second contact.

18. The electronic apparatus of claim 16, the conductive film directly contacting the second contact, the conductive film being spaced apart from the first contact structure, an electrical signal being transferred between the second contact and the first contact structure by a dielectric coupling phenomenon.

19. The electronic apparatus of claim 15, the first contact structure being spaced apart from the antenna pattern, an electrical signal being transferred between the first contact structure and the antenna pattern by a dielectric coupling phenomenon.

20. A method of manufacturing an electronic apparatus, the method comprising:

providing a window having a recess in a bottom surface of the window;

forming an antenna pattern on an inner surface of the recess;

forming an insulation layer to cover the antenna pattern, the insulation layer filling the recess;

forming a first contact structure through the insulation layer;

forming a display panel on a substrate in a housing, the housing having a opening;

forming a second contact structure on the substrate, the second contact structure having a first contact, a second contact spaced apart from the first contact in a direction substantially perpendicular to a top surface of the substrate, and a buffer member having a predetermined elasticity and electrically connecting the first contact with the second contact; and combining the window with the housing to cover the opening of the housing, such that the first contact structure is electrically connected to the second contact structure.

* * * * *